US010794397B2

(12) United States Patent
Sakamoto et al.

(10) Patent No.: US 10,794,397 B2
(45) Date of Patent: Oct. 6, 2020

(54) ROTOR BLADE AND AXIAL FLOW ROTARY MACHINE

(71) Applicant: MITSUBISHI HEAVY INDUSTRIES, LTD., Tokyo (JP)

(72) Inventors: Yasuro Sakamoto, Tokyo (JP); Hiroyuki Hamana, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 224 days.

(21) Appl. No.: 15/552,624

(22) PCT Filed: Apr. 3, 2015

(86) PCT No.: PCT/JP2015/060650
§ 371 (c)(1),
(2) Date: Aug. 22, 2017

(87) PCT Pub. No.: WO2016/157530
PCT Pub. Date: Oct. 6, 2016

(65) Prior Publication Data

US 2018/0051714 A1 Feb. 22, 2018

(51) Int. Cl.
*F04D 29/54* (2006.01)
*F01D 9/04* (2006.01)
(Continued)

(52) U.S. Cl.
CPC ..... *F04D 29/547* (2013.01); *F01D 9/041* (2013.01); *F04D 29/324* (2013.01); *F04D 29/542* (2013.01); *F04D 29/667* (2013.01)

(58) Field of Classification Search
CPC ..... F01D 9/041; F04D 29/324; F04D 29/542; F04D 29/547; F04D 29/667
See application file for complete search history.

(56) References Cited

U.S. PATENT DOCUMENTS 8,328,513 B2 12/2012 Kirtley
2002/0159886 A1 10/2002 Hiyama et al.
(Continued)

FOREIGN PATENT DOCUMENTS

GB 657366 9/1951
JP 62-195495 8/1987
(Continued)

OTHER PUBLICATIONS

Machine Translation of JP-62195495-A PDF File Name: "JP62195495A_Machine_Translation.pdf" (Year: 1987).*
(Continued)

*Primary Examiner* — Lindsay M Low
*Assistant Examiner* — Ruben Picon-Feliciano
(74) *Attorney, Agent, or Firm* — Wenderoth, Lind & Ponack, L.L.P.

(57) ABSTRACT

A rotor blade (22) provided in an axial flow compressor (1) including a rotating shaft, a casing (3), a diffuser portion (4) provided on a downstream side of the casing to communicate with a flow path (C) of the casing and form an annular shape and configured to define a diffuser flow path (DC) in which a cross-sectional area of the flow path expands toward the downstream side, a plurality of stator vane rows (10), and rotor blade rows (20) performing compression of a gas. A plurality of rotor blades are spaced apart from each other in a circumferential direction, and constitute a final rotor blade row (20A) positioned on a most downstream side among the rotor blade rows, and include a blade portion (25) having a larger deflection angle on a hub side and a chip side than at a central portion in a blade height direction.

9 Claims, 7 Drawing Sheets

(51) Int. Cl.
*F04D 29/32* (2006.01)
*F04D 29/66* (2006.01)

(56) References Cited

U.S. PATENT DOCUMENTS

| | | | |
|---|---|---|---|
| 2008/0226454 | A1 | 9/2008 | Decker et al. |
| 2011/0158798 | A1 | 6/2011 | Kirtley |
| 2014/0041395 | A1 | 2/2014 | Kitagawa et al. |
| 2014/0356154 | A1 | 12/2014 | Iliopoulou |
| 2016/0017734 | A1 | 1/2016 | Nishimura et al. |

FOREIGN PATENT DOCUMENTS

| | | | | |
|---|---|---|---|---|
| JP | 62195495 | A | * | 8/1987 |
| JP | 2000-314397 | | | 11/2000 |
| JP | 2006-322462 | | | 11/2006 |
| JP | 2011-137463 | | | 7/2011 |
| JP | 2011-169172 | | | 9/2011 |
| JP | 2011169172 | A | * | 9/2011 |
| JP | 2012-207648 | | | 10/2012 |
| JP | 2013-224627 | | | 10/2013 |
| JP | 2013224627 | A | * | 10/2013 |
| JP | 2014-194191 | | | 10/2014 |
| JP | 2014194191 | A | * | 10/2014 ..... F01D 5/143 |

OTHER PUBLICATIONS

Machine Translation of JP-2014194191-A PDF File Name: "JP2014194191A_Machine_Translation.pdf" (Year: 2014).*
Machine Translation of JP-2011169172-A PDF File Name: "JP2011169172A_Machine_Translation.pdf" (Year: 2011).*
Machine Translation of JP-2013224627-A PDF File Name: "JP2013224627A_Machine_Translation.pdf" (Year: 2013).*
International Search Report dated Jul. 7, 2015 in International (PCT) Application No. PCT/JP2015/060650, with English translation.
Written Opinion of the International Searching Authority dated Jul. 7, 2015 in International (PCT) Application No. PCT/JP2015/060650, with English translation.

* cited by examiner

ROTOR BLADE AND AXIAL FLOW ROTARY MACHINE

TECHNICAL FIELD

The present invention relates to a rotor blade used for an axial flow rotary machine and an axial flow rotary machine including the same.

BACKGROUND ART

For example, as one type of an axial flow rotary machine, an axial flow compressor is known. In the axial flow rotary machine, a fluid such as air is suctioned, the fluid is compressed by passing through rotor blades provided in a plurality of rows on a rotating shaft and stator vanes provided in a casing alternately with the rotor blades, and the compressed fluid is discharged through a diffuser portion.

In Patent Literature 1, a gas turbine in which such an axial flow compressor is provided is disclosed.

In the gas turbine, the turbine is driven with a combustion gas obtained by burning a mixture of the compressed air from the axial flow compressor and fuel to generate rotational power.

Incidentally, in the diffuser portion of the axial flow compressor, a diffuser flow path is formed so that a cross-sectional area of the flow path gradually increases toward a downstream side of a flow of the fluid. This diffuser flow path reduces a flow velocity of the compressed fluid to recover pressure.

CITATION LIST

Patent Literature

[Patent Literature 1]
Japanese Unexamined Patent Application, First Publication No. 2011-169172

SUMMARY OF INVENTION

Technical Problem

However, a flow velocity distribution (a pressure distribution) in a radial direction of a rotating shaft is generated due to an influence of shearing between a fluid introduced into a diffuser portion and an inner surface of a casing. For this reason, when a fluid flows through a diffuser flow path, separation of the fluid occurs easily on an inner surface of the diffuser flow path and thus loss may occur.

In consideration of the above-mentioned circumstances, the present invention is directed to providing a rotor blade and an axial flow compressor capable of reducing loss in a diffuser portion and obtaining sufficient pressure recovery performance.

Solution to Problem

To solve the problem described above, the present invention employs the following means.

In a first aspect of the present invention, a rotor blade is provided in an axial flow rotary machine, wherein the axial flow rotary machine includes a rotating shaft which extends in the direction of the axis and rotates about the axis, a casing which supports the rotating shaft to be rotatable from an outer circumferential side and defines a flow path of the fluid between the rotating shaft and the casing, a diffuser portion provided on a downstream side of the casing to communicate with the flow path and form an annular shape about the axis and configured to define a diffuser flow path in which a cross-sectional area of the flow path expands toward the downstream side, a plurality of stator vane rows provided in a direction of the axis and protruding from the casing toward a radial inner side of the axis, and a plurality of rotor blade rows provided adjacent to the stator vane rows in the direction of the axis and configured to perform compression or pressure-feeding of the fluid, and the a plurality of rotor blade are provided to be spaced apart from each other in a circumferential direction of an axis and configured to constitute a final rotor blade row positioned on a most downstream side of a flow of a fluid among rotor blade rows, and includes a blade portion having a larger deflection angle on a hub side and a chip side than at a central portion in a blade height direction.

According to such rotor blades, the deflection angle of the blade portion in the rotor blades of the final rotor blade row, that is, a relative angle between a flow direction of a fluid at an inlet of the blade portion and a flow direction of the fluid at an outlet of the blade portion, is larger on the hub side and the chip side than at the central portion in the blade height direction. For this reason, the flow direction of the fluid passing through the final rotor blade row is changed more on the hub side and the chip side. Accordingly, each of the rotor blades performs more work on the fluid on the hub side and the chip side and an amount of compression (an amount of pressure-feeding) of the fluid is increased at those positions.

Here, when it is assumed that the deflection angle of the rotor blade is uniform in the blade height direction, a flow velocity of the fluid decreases on the hub side and the chip side due to an influence of a shearing force between the fluid and an inner surface of the flow path of the casing.

In this respect, by changing the deflection angle of the rotor blade in the blade height direction as described above, the flow velocity of the fluid in the vicinity of the inner surface of the flow path is increased and a velocity (total pressure) distribution of the fluid that has passed the final rotor blade row can be more uniform at an outlet of the diffuser portion in the blade height direction, that is, in a radial direction of the axis. As a result, separation of the fluid in the diffuser flow path can be suppressed.

Further, since separation of the fluid is suppressed as described above, pressure can be stably recovered even when a dimension of the diffuser portion in the direction of the axis is shortened and friction loss of the fluid caused by friction with the diffuser flow path can be reduced.

In addition, since separation of the fluid is suppressed, a ratio of the cross-sectional area of the flow path between the inlet and outlet of the diffuser flow path can be increased, and it is possible to increase an amount of pressure recovery.

In a second aspect of the present invention, an axial flow rotary machine includes the rotor blade rows having the rotor blades according to the first aspect, a rotating shaft which fixes the rotor blade rows, extends in a direction of the axis, and rotates about the axis, a casing which supports the rotating shaft to be rotatable from an outer circumferential side and defines a flow path of a fluid between the rotating shaft and the casing, a diffuser portion provided on a downstream side of the casing to communicate with the flow path and form an annular shape about the axis and configured to define a diffuser flow path in which a cross-sectional area of the flow path expands toward the downstream side, and a plurality of stator vane rows provided adjacent to the rotor blade rows in the direction of the axis, protruding from the casing toward a radial inner side of the axis and having stator vanes provided to be spaced apart from each other in a circumferential direction of the axis in each of the rows.

According to such an axial flow rotary machine, since the rotor blades described above are provided in the final rotor blade row, the flow velocity of the fluid in the vicinity of the inner surface of the flow path of the casing is increased and a velocity (total pressure) distribution of the fluid that has passed the final rotor blade row can be more uniform at an outlet of the diffuser portion in the blade height direction, that is, in the radial direction of the axis.

In a third aspect of the present invention, the diffuser portion of the second aspect described above may be provided in the casing so that the diffuser flow path extends on the downstream side of an end portion on an upstream side of a final rotor blade row and from an upstream side of an end portion on the downstream side of a final stator vane row provided further downstream from the final rotor blade row.

Since the deflection angle of the rotor blade of the final rotor blade row is different in the blade height direction, the fluid whose total pressure has increased near the inner surface of the flow path is introduced into the diffuser flow path and separation of the fluid cannot easily occur in the diffuser flow path. Therefore, loss cannot easily occur even when the diffuser flow path is started from a position on the downstream side of the final rotor blade row including a position in which the final rotor blade row is provided and from an upstream side of the final stator vane row. Thus, in this way, it is possible to perform the pressure recovery at an earlier stage while obtaining a deceleration effect of the fluid by the final stator vane row. As a result, it is possible to further shorten the length of the diffuser portion in the direction of the axis or further increase the ratio of the cross-sectional area of the flow path between the inlet and outlet of the diffuser flow path.

In a fourth aspect of the present invention, in the diffuser portion of the third aspect described above, a portion of an inner surface of the diffuser flow path may be formed with a portion of the stator vane of the final stator vane row.

In this way, since a portion of the stator vane forms the inner surface of the diffuser flow path as described above, even when the diffuser flow path expands from the upstream side of the end portion on the downstream side of the final stator vane row, a portion of the stator vane (for example, a shroud or the like) does not protrude from the inner surface of the diffuser flow path expanding toward the downstream side to the diffuser flow path. Therefore, the fluid can flow more smoothly toward the downstream side in the diffuser flow path and separation of the fluid can be further suppressed.

In a fifth aspect of the present invention, in the diffuser portion of the third or fourth aspect described above, the diffuser flow path may be divided into a first region corresponding to a region in the direction of the axis in which the final stator vane row is provided, a second region on the downstream side of the first region, and a third region further downstream from the second region, and an amount of expansion in a cross-sectional area of the flow path in the second region may be larger than that in the first region and an amount of expansion in a cross-sectional area of the flow path in the third region may be smaller than that in the second region.

In this way, from the first region toward the third region, that is, toward the downstream side, the diffuser flow path expands slightly at first, expands greatly thereafter, and then expands slightly. Therefore, when the fluid passes through the final stator vane row, that is, passes through the first region, since an amount of deceleration of the fluid from the diffuser flow path can be reduced, it is possible to suppress the separation of the fluid in the final stator vane row. Thereafter, when the fluid passes through the second region, the amount of deceleration of the fluid can be increased by the diffuser flow path and a sufficient amount of pressure recovery can be obtained. Although a boundary layer of the fluid develops in the third region on the most downstream side, since the amount of deceleration of the fluid can be reduced, the separation in the third region can be suppressed.

Here, the amount of expansion in a cross-sectional area of the flow path means an angle with respect to the axis of the diffuser flow path in each region, that is, an opening angle.

In a sixth aspect of the present invention, in the diffuser portion of the third or fourth aspect described above, the diffuser flow path may be divided into a first region corresponding to a region in the direction of the axis in which the final stator vane row is provided, and a second region on the downstream side of the first region, and an amount of expansion in a cross-sectional area of the flow path in the second region is smaller than that in the first region.

The diffuser flow path expands slightly in the second region compared to the first region. In this case, since the diffuser flow path is open from the first region, an amount of deceleration in the first region can be increased while suppressing separation of the fluid on the inner surface (end wall) of the diffuser flow path on the downstream side of the first region. Therefore, even when a boundary layer develops in the second region, the fluid can be decelerated without separation.

In a seventh aspect of the present invention, in the diffuser portion in any one of the third to sixth aspects described above, the cross-sectional area of the flow path may expand so that an inner surface on a radial outer side of the axis in the diffuser flow path is inclined toward the radial outer side toward the downstream side.

Here, since the fluid is introduced into the diffuser flow path in a state in which it has a component in a rotating direction of the rotating shaft, the fluid flows through the inside of the diffuser flow path in a state in which the fluid is close to the inner surface side on the radial outer side of the diffuser flow path. Therefore, the diffuser flow path is formed along such a flow direction of the fluid in which the cross-sectional area of the flow path of the diffuser flow path expands to be inclined toward the radial outer side. Accordingly, the fluid can flow more smoothly in the diffuser flow path, and the effect of pressure recovery can be improved.

In an eighth aspect of the present invention, in the diffuser portion of the seventh aspect described above, the cross-sectional area of the flow path may expand so that the inner surface on the radial inner side of the axis in the diffuser flow path is inclined toward the radial inner side toward the downstream side.

In this way, in the diffuser flow path, in addition to the inner surface on the radial outer side, since the inner surface on the radial inner side is inclined toward the radial inner side toward the downstream side, it is possible to achieve expansion of the diffuser flow path and pressure recovery in a shorter distance. Thus, a length of the diffuser flow path in the direction of the axis can be decreased, and friction loss of the fluid can be reduced.

In a ninth aspect of the present invention, in the diffuser portion of the seventh aspect described above, the cross-sectional area of the flow path may expand so that the inner surface on the radial inner side of the axis in the diffuser flow path is inclined toward the radial outer side toward the downstream side.

In this way, in the diffuser flow path, in addition to the inner surface on the radial outer side, since the inner surface on the radial inner side is inclined toward the radial outer side toward the downstream side, it is possible to guide the compressed or pressure-fed fluid, for example, to equipment disposed on the radial outer side.

In a tenth aspect of the present invention, an axial flow rotary machine includes a rotating shaft which extends in a direction of an axis and rotates about the axis, a casing which supports the rotating shaft to be rotatable from an outer circumferential side and defines a flow path of a fluid between the rotating shaft and the casing, a diffuser portion provided on a downstream side of the casing to communicate with the flow path and form an annular shape about the axis and configured to define a diffuser flow path in which a cross-sectional area of the flow path expands toward the downstream side, a plurality of stator vane rows provided in a direction of the axis and protruding from the casing toward a radial inner side of the axis, and a plurality of rotor blade rows provided adjacent to the stator vane rows in the direction of the axis and configured to perform compression or pressure-feeding of the fluid, wherein the diffuser portion is provided in the casing so that the diffuser flow path extends on the downstream side of an end portion on an upstream side of a final rotor blade row and from an upstream side of an end portion on the downstream side of a final stator vane row provided further downstream from the final rotor blade row.

In an eleventh aspect of the present invention, in the diffuser portion of the tenth aspect described above, a portion of an inner surface of the diffuser flow path may be formed with a portion of the stator vane of the final stator vane row.

In a twelfth aspect of the present invention, in the diffuser portion of the tenth or eleventh aspect described above, the diffuser flow path may be divided into a first region corresponding to a region in the direction of the axis in which the first final stator vane row is provided, a second region on the downstream side of the first region, and a third region further downstream from the second region, and an amount of expansion in a cross-sectional area of the flow path in the second region may be larger than that in the first region and an amount of expansion in a cross-sectional area of the flow path in the third region may be smaller than that in the second region.

In a thirteenth aspect of the present invention, in the diffuser portion of the tenth or eleventh aspect described above, the diffuser flow path may be divided into a first region corresponding to a region in the direction of the axis in which the final stator vane row is provided and a second region on the downstream side of the first region, and an amount of expansion in a cross-sectional area of the flow path in the second region may be smaller than that in the first region.

In a fourteenth aspect of the present invention, in the diffuser portion in any one of the tenth to thirteenth aspects described above, the cross-sectional area of the flow path may expand so that an inner surface on a radial outer side of the axis in the diffuser flow path is inclined toward the radial outer side toward the downstream side.

In a fifteenth aspect of the present invention, in the diffuser portion of the fourteenth aspect described above, the cross-sectional area of the flow path may expand so that the inner surface on the radial inner side of the axis in the diffuser flow path is inclined toward the radial inner side toward the downstream side.

In a sixteenth aspect of the present invention, in the diffuser portion of the fourteenth aspect described above, the cross-sectional area of the flow path may expand so that the inner surface on the radial inner side of the axis in the diffuser flow path is inclined toward the radial outer side toward the downstream side.

Advantageous Effects of the Invention

According to the rotor blade and the axial flow rotary machine described above, it is possible to reduce flow loss of a fluid in the diffuser portion and obtain sufficient pressure recovery performance.

DESCRIPTION OF EMBODIMENTS

First Embodiment

Hereinafter, an axial flow compressor 1 (an axial flow rotary machine) according to a first embodiment of the present invention will be described with reference to the drawings.

Figure 1:
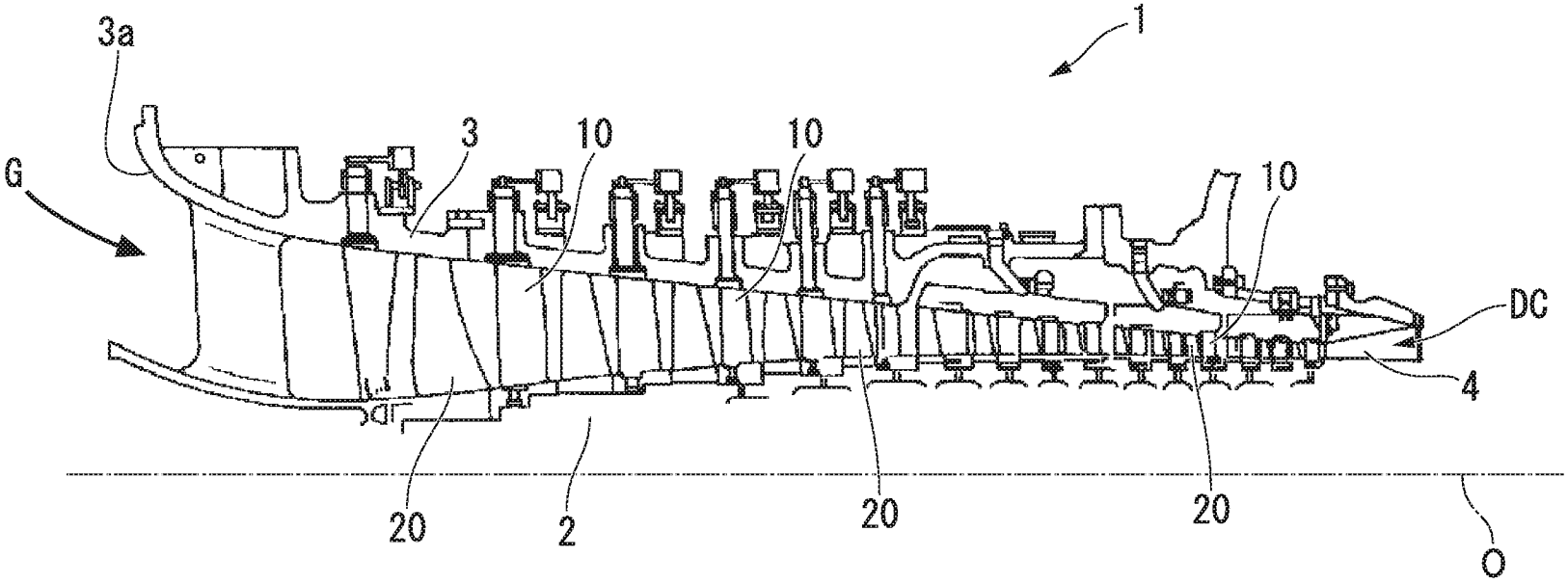
FIG. 1 is a longitudinal sectional view of an axial flow compressor including an axis according to a first embodiment of the present invention.
Figure 2:
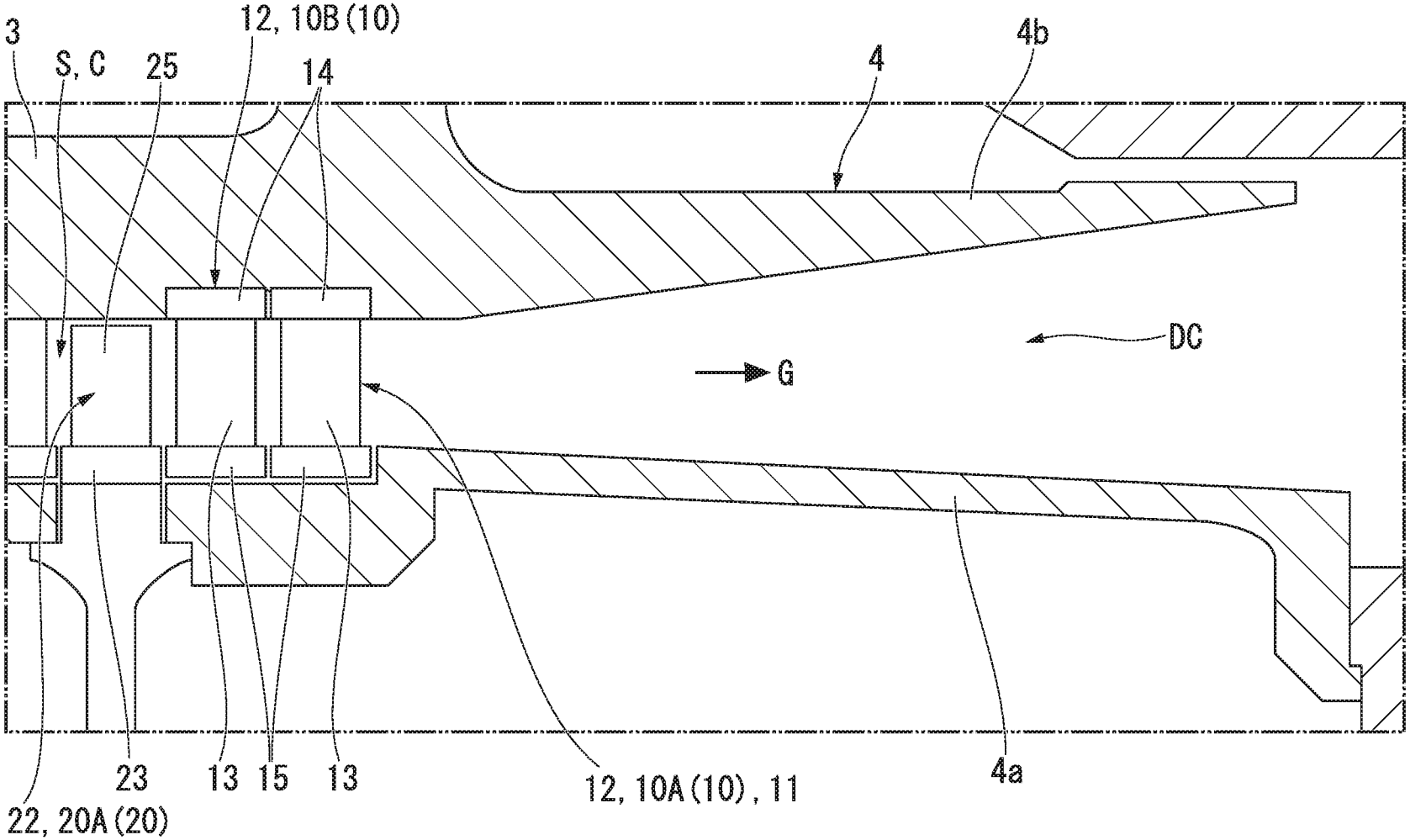
FIG. 2 is a longitudinal sectional view of an axial flow compressor including an axis according to the first embodiment of the present invention and is a view in which a periphery of a diffuser portion is enlarged for illustration.

The axial flow compressor 1 suctions, compresses, and discharges a gas G (a fluid) such as air. As illustrated in FIGS. 1 and 2, the axial flow compressor 1 includes a rotating shaft 2 which rotates about an axis O, a casing 3 which supports the rotating shaft 2, a diffuser portion 4 provided in the casing 3, a stator vane row 10 which protrudes from the casing 3 toward the rotating shaft 2, and a rotor blade row 20 which protrudes from the rotating shaft 2 toward the casing 3.

The rotating shaft 2 is a columnar member extending in a direction of the axis O.

The casing 3 has a tubular shape covering the rotating shaft 2 from an outer circumferential side. A bearing (not illustrated) is provided in the casing 3. The casing 3 supports the rotating shaft 2 via the bearing so that the casing 3 and the rotating shaft 2 are rotatable relative to each other. Also, a space S is defined between the casing 3 and the rotating shaft 2.

A suction port 3*a* for the gas G which is open to the outside of the casing 3 on one side in the direction of the axis O (a left side as viewed in FIG. 1) and communicates with the space S is formed in the casing 3. The gas G is introduced into the space S from the suction port 3*a* and flows from one side to the other side in the direction of the axis O. Hereinafter, one side in the direction of the axis O is defined as an upstream side and the other side is defined as a downstream side.

A plurality of stator vane rows 10 are fixed to the casing 3, protrude from the casing 3 to a radial inner side of the axis O to be arranged in the space S, and are provided to be spaced apart from each other in the direction of the axis O.

Each of the stator vane rows 10 has a plurality of stator vanes 12 which are provided to be spaced apart from each other in a circumferential direction of the axis O.

Each of the stator vanes 12 includes a vane portion 13 having an airfoil shape in a cross section perpendicular to the radial direction, an outer shroud 14 provided on a radial outer side of the vane portion 13, and an inner shroud 15 provided on a radial inner side of the vane portion 13. The outer shroud 14 is fitted into the casing 3 and constitutes part of an inner surface of the casing 3. The inner shrouds 15 of the stator vanes 12 adjacent to each other in the circumferential direction are coupled to each other to form an annular shape about the axis O.

In the present embodiment, an outlet guide vane 11 (or stator vane 12) is provided on the most downstream side of the space S in the casing 3, but such an outlet guide vane 11 (or stator vane 12) may not necessarily be provided.

A plurality of rotor blade rows 20 are fixed to the rotating shaft 2, protrude from the rotating shaft 2 to a radial outer side of the axis O to be arranged in the space S, and are provided to be spaced apart from each other in the direction of the axis O. These rotor blade rows 20 are provided adjacent to the stator vane rows 10 between the stator vane rows 10 in the direction of the axis O.

Here, on the most downstream side of the casing 3, a rotor blade row 20 is not adjacent to the upstream side of the outlet guide vane 11, and two rows of the stator vane rows 10 are provided adjacent to each other in the direction of the axis O.

Of the two adjacent rows of the stator vane rows 10, the outlet guide vane 11 is referred to as a first final stator vane row 10A and the stator vane row 10 provided on the upstream side of the outlet guide vane 11 is referred to as a second final stator vane row 10B.

On the upstream side of the second final stator vane row 10B, the rotor blade row 20 is provided adjacent thereto in the direction of the axis O. This rotor blade row 20 is referred to as a final rotor blade row 20A.

The final rotor blade row 20A has a plurality of rotor blades 22 provided to be spaced apart from each other in the circumferential direction of the axis O.

Figure 3:
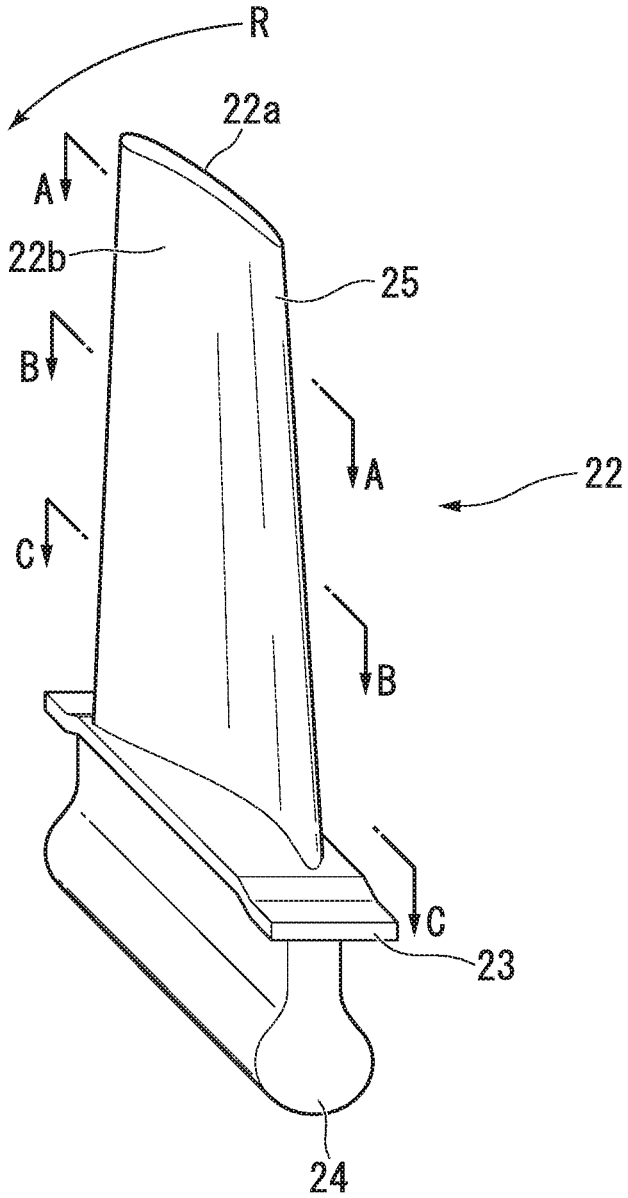
FIG. 3 is a perspective view illustrating a rotor blade constituting a final rotor blade row of an axial flow compressor according to the first embodiment of the present invention.
Figure 4A:
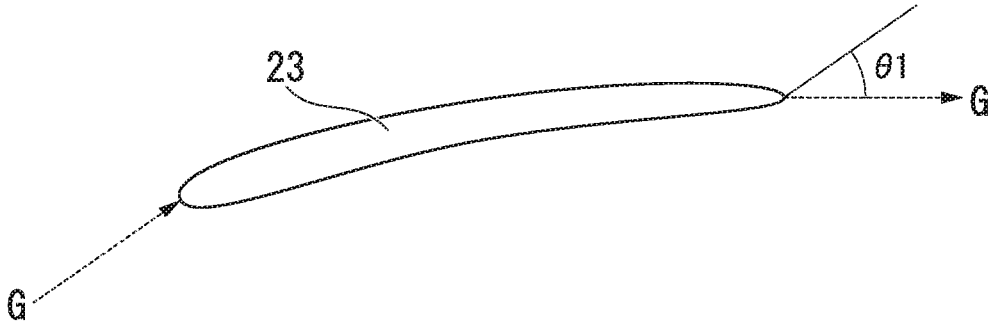
FIG. 4A is a cross-sectional view perpendicular to a blade height direction of a rotor blade constituting a final rotor blade row of an axial flow compressor according to the first embodiment of the present invention and illustrates a cross-section taken along line A-A of FIG. 3.
Figure 4B:
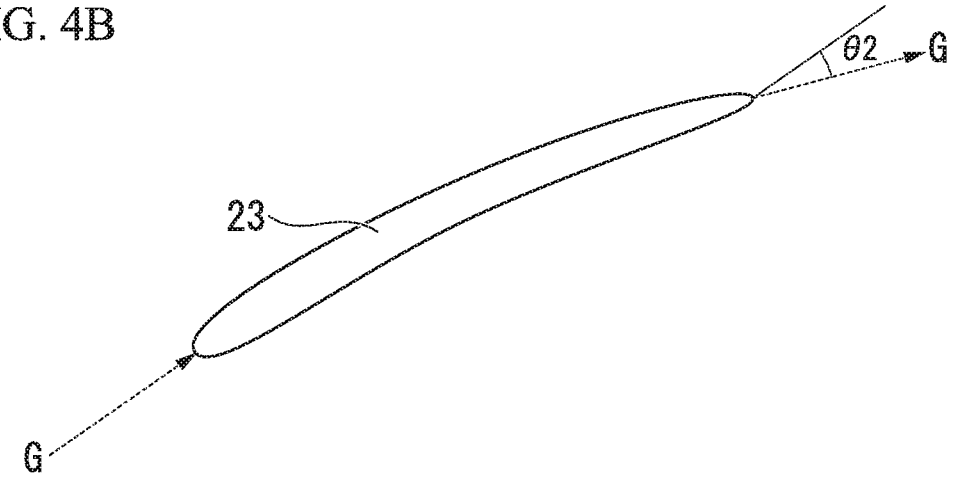
FIG. 4B is a cross-sectional view perpendicular to a blade height direction of a rotor blade constituting a final rotor blade row of an axial flow compressor according to the first embodiment of the present invention and illustrates a cross-section taken along line B-B of FIG. 3.
Figure 4C:
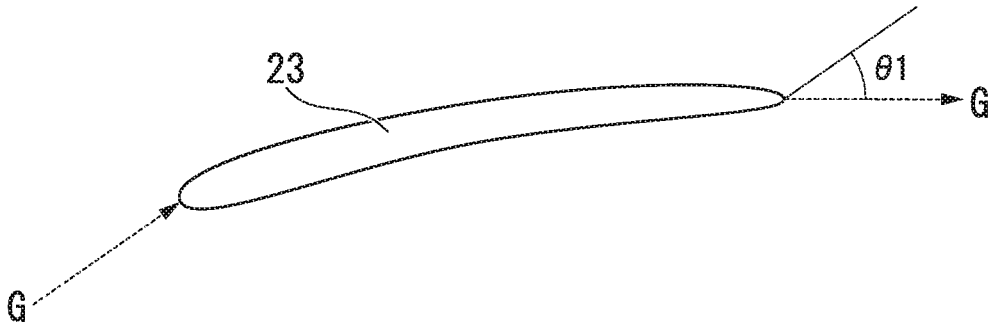
FIG. 4C is a cross-sectional view perpendicular to a blade height direction of a rotor blade constituting a final rotor blade row of an axial flow compressor according to the first embodiment of the present invention and illustrates a cross-section taken along line C-C of FIG. 3.

As illustrated in FIGS. 3 to 4C, each of the rotor blades 22 includes a blade portion 25 having an airfoil shape in a cross section perpendicular to the radial direction, a platform 23 provided on the radial inner side of the blade portion 25, and a blade root 24 protruding toward the radial inner side from the platform 23.

The rotor blade 22 is fixed to the rotating shaft 2 by fitting the blade root 24 into the rotating shaft 2. The blade portion 25 includes a suction side 22*a* facing a rear side in a rotating direction R of the rotating shaft 2 and a pressure side 22*b* facing a front side in the rotating direction R.

In the space S of the casing 3, gaps formed between the stator vanes 12 and between the rotor blades 22 serve as a flow path C through which the gas G introduced from a suction port 3*a* flows. The gas G introduced into the flow path C is compressed by passing through the blade portion 25 of the rotor blade 22 of each of the rotor blade rows 20 and changing its angle along the pressure side 22*b* of the rotor blade 22.

The blade portion 25 of the rotor blade 22 has a larger deflection angle on a hub side (radial inner side) and on a chip side (radial outer side) thereof than at a central portion in a blade height direction, that is, in the radial direction of the axis O. Specifically, as illustrated in FIGS. 4A and 4C, on the hub side and the chip side, a relative angle θ1 with a flow direction of a fluid at an outlet of the blade portion 25 with respect to a flowing direction of the gas G at an inlet of the blade portion 25 shows a steeper (larger) angle. On the other hand, as illustrated in FIG. 4B, a relative angle θ2 at the central portion in the blade height direction shows a gentler (smaller) angle.

It is preferable that the angles θ1 and θ2 smoothly change from the central portion in the blade height direction toward the hub side and the chip side.

The diffuser portion 4 is provided on the downstream side of the casing 3 and has a tubular shape about the axis O. More specifically, the diffuser portion 4 is formed in a double tubular shape having a combustor basket formed about the axis O and an outer shell 4*b* formed about the axis O to have a diameter larger than a diameter of a combustor basket 4*a*.

The rotating shaft 2 is disposed inside the combustor basket 4*a*. An annular space defined between the combustor basket 4*a* and the outer shell 4*b* is a diffuser flow path DC communicating with the space S, that is, the flow path C of the casing 3. The diffuser flow path DC is defined so that a cross-sectional area of the flow path enlarges toward the downstream side. Here, the cross-sectional area of the flow path refers to an area of a cross section perpendicular to the axis O.

The gas G compressed by flowing through the flow path C is discharged to the outside of the axial flow compressor 1 via the diffuser flow path DC.

The diffuser portion 4 may be provided integrally with the casing 3 or may be provided separately.

In the present embodiment, the diffuser portion 4 is provided in the casing 3 so that the diffuser flow path DC extends from the downstream side of the first final stator vane row 10A.

According to such an axial flow compressor 1, the deflection angle of the blade portion 25 in the rotor blade 22 of the final rotor blade row 20A is larger on the hub side and the chip side than at the central portion in the blade height direction.

Therefore, a flow direction of the gas G passing through the final rotor blade row 20A is changed more on the hub side and the chip side. Accordingly, the rotor blade 22 performs more work on the fluid on the hub side and the chip side and an amount of compression of the gas G is increased at those positions.

Here, when it is assumed that the deflection angle of the rotor blade 22 is uniform in the blade height direction, a flow velocity of the gas G decreases on the hub side and the chip side due to an influence of a shearing force between the gas G and an inner surface of the diffuser flow path DC. In this regard, since the deflection angles θ1 and θ2 of the blade portion 25 of the rotor blade 22 are different in the blade height direction as described above, by increasing a flow velocity of the gas G in the vicinity of the inner surface of the diffuser flow path DC, a velocity (a total pressure) distribution of the gas G that has passed through the final rotor blade row 20A can be more uniform at an outlet of the diffuser portion 4 in the blade height direction, that is, in the radial direction of the axis O. Therefore, separation of the gas G in the diffuser flow path DC can be suppressed.

Here, in general, in order to improve performance of pressure recovery in the diffuser portion 4, it is necessary to increase a ratio of the cross-sectional area of the flow path between the inlet and outlet of the diffuser flow path DC. Also, the diffuser flow path DC is formed to expand the cross-sectional area of the flow path while suppressing an opening angle of the flow path C to a predetermined angle so that separation of the gas G is not generated.

Here, the opening angle used here indicates the sum of an angle at which a surface on the radial inner side of the diffuser flow path DC, which is a surface of the combustor basket 4*a*, is inclined relative to the axis O and an angle at which a surface on the radial outer side of the diffuser flow path DC, which is a surface of the outer shell 4*b*, is inclined with respect to the axis O in the radial direction.

Therefore, when it is assumed that the deflection angles θ1 and θ2 of the rotor blade 22 are the same and the blade portion 25 has a uniform shape in the radial direction, a length dimension of the diffuser portion 4 in the direction of the axis O increases in order to maintain the function of pressure recovery in the diffuser portion 4. As a result, a distance in which the gas G is in contact with the inner surface of the diffuser flow path DC increases and loss due to friction of the gas G increases.

In this regard, in the present embodiment, a dimension in the direction of the axis O of the diffuser portion 4 can be decreased by making the velocity distribution of the gas G uniform as described above. Therefore, the friction loss of the gas G caused by the friction with the diffuser flow path DC can be reduced.

In addition, when the velocity distribution of the gas G is made uniform, the ratio of the cross-sectional area of the flow path between the inlet and outlet of the diffuser flow path DC can also be increased, and it is possible to increase an amount of the pressure recovery in the diffuser portion 4. That is, for example, the opening angle of the diffuser flow path DC can also be 10 degrees or more.

Second Embodiment

Hereinafter, an axial flow compressor 31 (an axial flow rotary machine) according to a second embodiment of the present invention will be described.

The same components as those in the first embodiment will be denoted by the same reference signs and detailed description thereof will be omitted.

Figure 5:
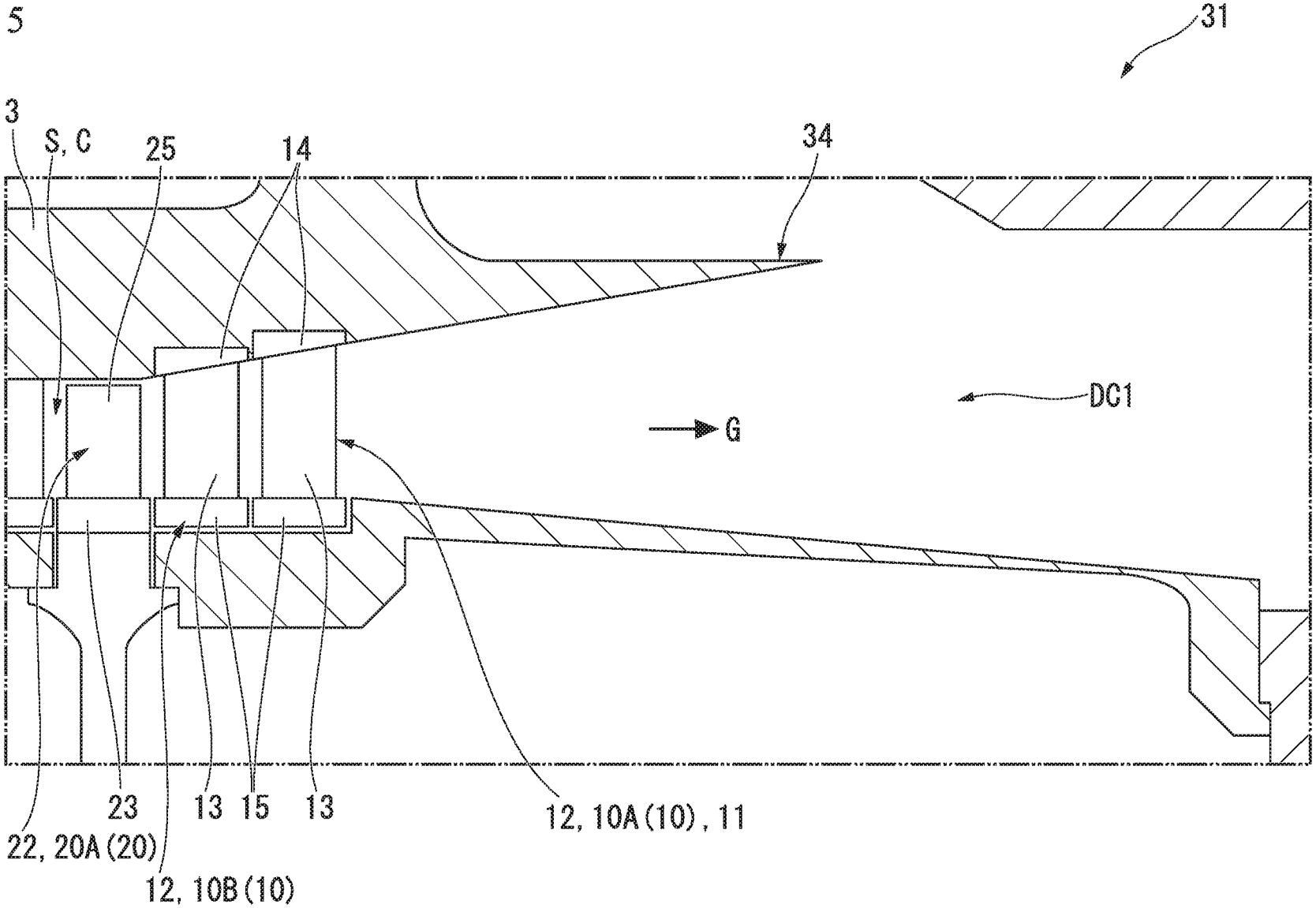
FIG. 5 is a longitudinal sectional view of an axial flow compressor including an axis according to a second embodiment of the present invention and is a view in which a periphery of a diffuser portion is enlarged for illustration.

As illustrated in FIG. 5, in the axial flow compressor 31, a diffuser portion 34 is provided in a casing 3 so that a diffuser flow path DC1 extends from a downstream side of a final rotor blade row 20A and from an upstream side of an end portion on a downstream side of a second final stator vane row 10B. Also, in the present embodiment, the diffuser flow path DC1 extends from between the final rotor blade row 20A and the second final stator vane row 10B.

Here, the end portion of the downstream side of the second final stator vane row 10B indicates an end portion on a downstream side of an outer shroud 14 and inner shroud 15 of the second final stator vane row 10B.

According to the axial flow compressor 31 of the present embodiment, it is possible to perform pressure recovery at an earlier stage while obtaining an effect of decelerating the gas G from the first final stator vane row 10A and the second final stator vane row 10B.

As a result, it is possible to further shorten the dimension in a direction of an axis O of the diffuser portion 34 or further increase a ratio of a cross-sectional area of the flow path between an inlet and outlet of the diffuser flow path DC1.

Figure 6:
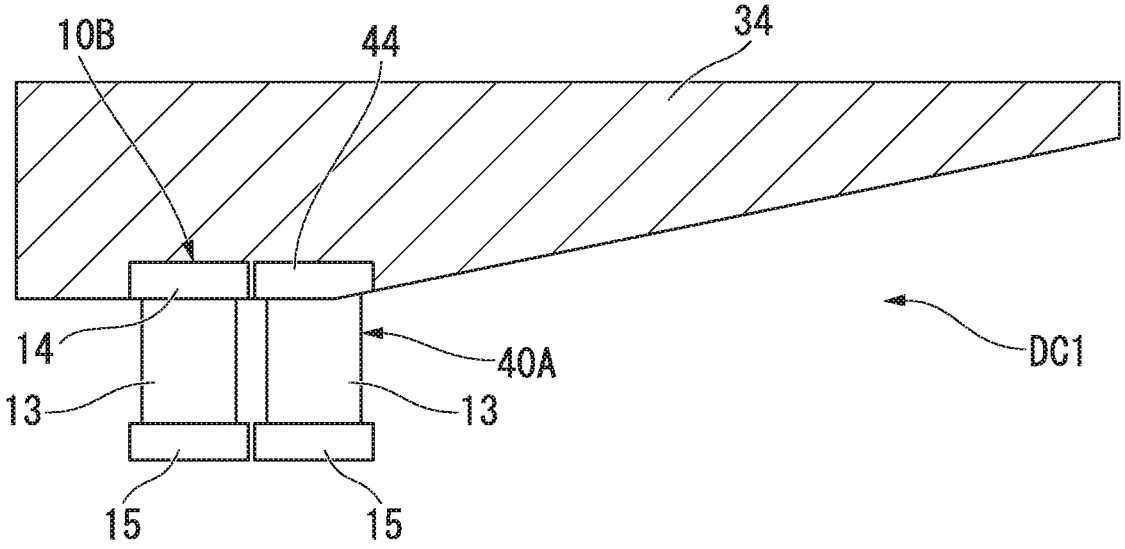
FIG. 6 is a longitudinal sectional view of an axial flow compressor including an axis according to a first modified example of the second embodiment of the present invention and is a view in which a periphery of a diffuser portion is further enlarged for illustration.

Here, since the gas G whose total pressure is increased near an inner surface (which means inner circumferential surfaces on both the outer and inner sides in the radial direction) of a flow path C which is an end wall portion in the radial direction by a rotor blade 22 of the final rotor blade row 20A is introduced into the diffuser flow path DC1, separation of the gas G cannot easily occur in the diffuser flow path DC1. Therefore, even in the diffuser flow path DC1 of the present embodiment, the pressure recovery can be performed while reducing loss of the gas G Here, in the present embodiment, as illustrated in FIGS. 6 and 7, the diffuser portion 34 may be provided in the casing 3 so that the diffuser flow path DC1 extends on a downstream side of an end portion on the downstream side of the second final stator vane row 10B and from an upstream side of an end portion on a downstream side of a first final stator vane row 40A.

The end portion on the downstream side of the first final stator vane row 40A indicates an end portion on a downstream side of the outer shroud 44 in the first final stator vane row 40A. Similarly, the end portion on the downstream side of the second final stator vane row 1013 indicates an end portion on a downstream side of the outer shroud 44 in the second final stator vane row 10B.

Also, in this case, a portion of an inner surface of the diffuser flow path DC1 is formed with a portion of a stator vane 12 of the first final stator vane row 40A, that is, the outer shroud 44. Specifically, in FIG. 6, a surface of the outer shroud 44 facing a radial inner side is inclined toward a radial outer side from a midway position in the direction of the axis O to the downstream side and forms a portion of the inner surface of the diffuser flow path DC1.

Figure 7:
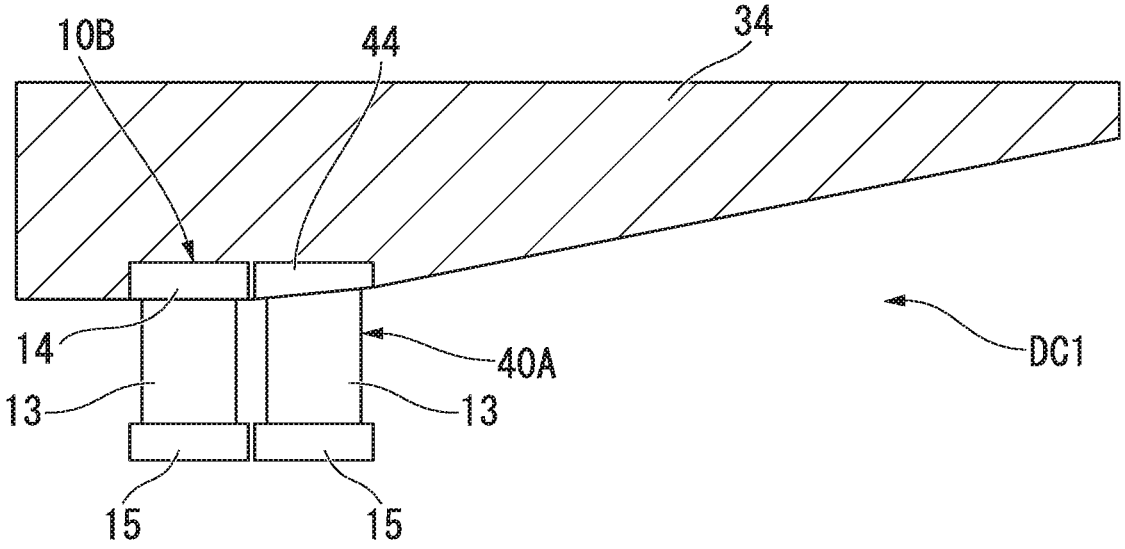
FIG. 7 is a longitudinal sectional view of an axial flow compressor including an axis according to a second modified example of the second embodiment of the present invention and is a view in which a periphery of a diffuser portion is further enlarged for illustration.

In addition, in FIG. 7, the surface of the outer shroud 44 facing the radial inner side is inclined toward the radial outer side toward the downstream side over the entire region in the direction of the axis O and forms a portion of the inner surface of the diffuser flow path DC1.

In this way, since the outer shroud 44 which is a portion of the stator vane 12 forms the inner surface of the diffuser flow path DC1, even when the diffuser flow path DC1 expands from the upper side of the end portion on the downstream side of the first final stator vane row 40A, the outer shroud 44 does not protrude from the inner surface of the diffuser flow path DC1 expanding toward the downstream side (see FIG. 5) to the inside of the diffuser flow path DC1.

Therefore, the gas G can flow more smoothly toward the downstream side in the diffuser flow path DC1 and the separation of the gas G can be further suppressed. In particular, since the surface of the outer shroud 44 facing the radial inner side and the surface of the diffuser flow path DC1 facing the radial inner side are set to be on the same plane, the effect of suppressing separation of the gas G can be improved.

Here, in the present embodiment, as illustrated in FIGS. 6 and 7, a surface of the outer shroud 14 of the second final stator vane row 10B facing the radial inner side may be inclined toward the radial outer side toward the downstream side to be a portion of the inner surface of the diffuser flow path DC1.

Third Embodiment

Hereinafter, an axial flow compressor 51 according to a third embodiment of the present invention will be described.

The same components as those in the first and second embodiments will be denoted with the same reference signs and detailed description thereof will be omitted.

Figure 8:
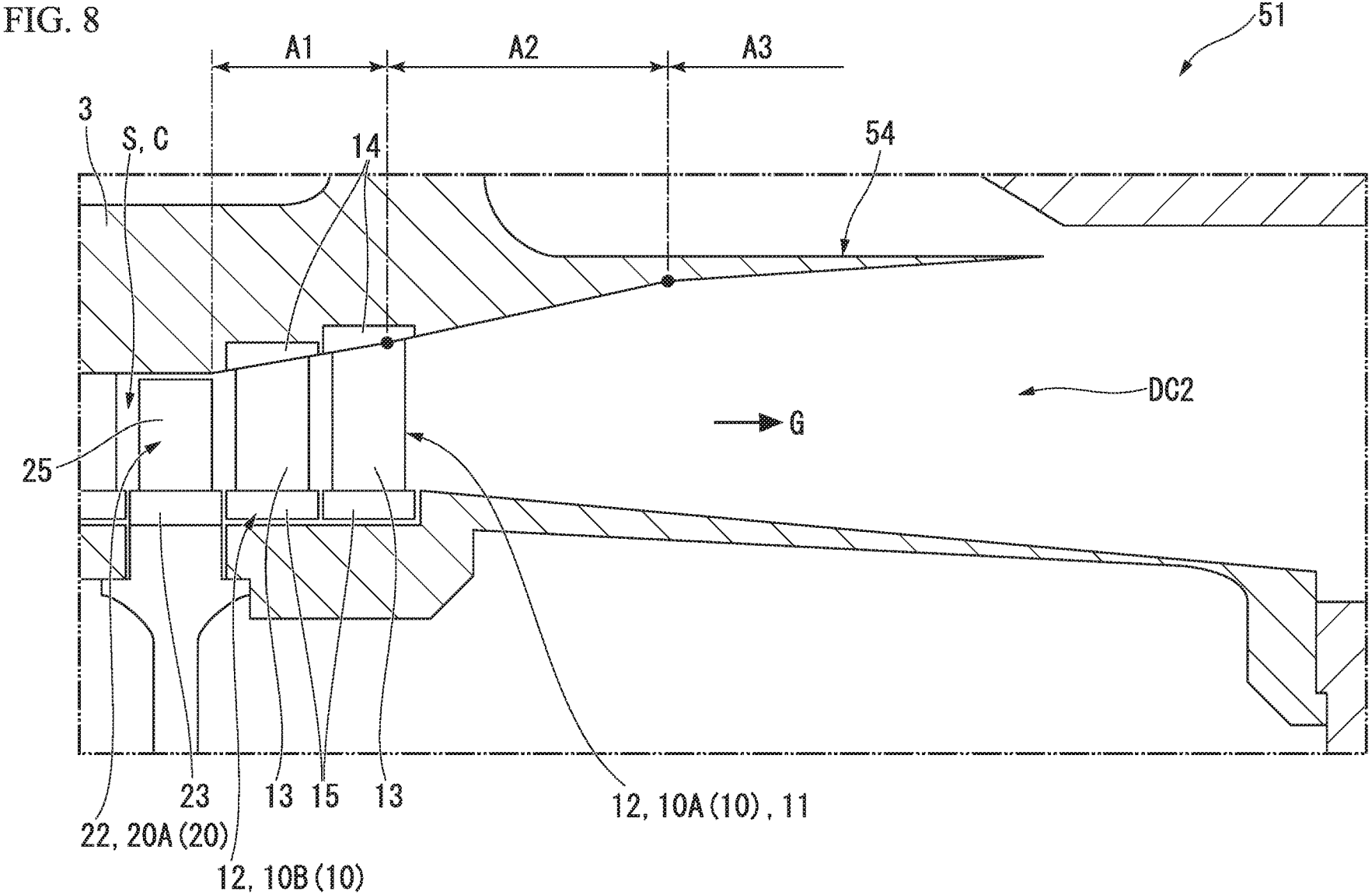
FIG. 8 is a longitudinal sectional view of an axial flow compressor including an axis according to a third embodiment of the present invention and is a view in which a periphery of a diffuser portion is enlarged for illustration.

As illustrated in FIG. 8, in a diffuser portion 54 of the axial flow compressor 51, a diffuser flow path DC2 is divided into a first region A1 corresponding to a region in a direction of an axis O in which a first final stator vane row 10A and a second final stator vane row 10B are provided, a second region A2 on a downstream side of the first region A1, and a third region A3 on a further downstream side of the second region A2.

An amount of expansion in a cross-sectional area of a flow path in the second region A2 is larger than that in the first region A1, and an amount of expansion in a cross-sectional area of the flow path in the third region A3 is smaller than that in the second region A2. Here, the amount of expansion in a cross-sectional area of a flow path means an opening angle of the diffuser flow path DC2 in each region.

As described above, from the first region A1 toward the third region A3, that is, toward the downstream side, the diffuser flow path DC2 expands slightly at first, expands greatly thereafter, and then expands slightly. Therefore, when a gas G passes through the first final stator vane row 10A and the second final stator vane row 10B, that is, when the gas G passes through the first region A1, an amount of deceleration of the gas G from the diffuser flow path DC2 can be reduced.

Therefore, separation of the gas G in the first final stator vane row 10A and the second final stator vane row 10B can be reduced.

Thereafter, when the gas G passes through the second region A2, an amount of deceleration of the gas G can be increased by the diffuser flow path DC2 and a sufficient amount of pressure recovery can be obtained. Further, although a boundary layer of the gas G develops in the third region A3 on the most downstream side, since the amount of deceleration of the gas G can be reduced, separation of the gas G can be suppressed. Therefore, pressure recovery can be effectively performed.

Here, in the present embodiment, the diffuser flow path DC2 may be divided into the first region A1 and the second region A2 on the downstream side of the first region A1. In this case, an amount of expansion in a cross-sectional area of the flow path may be smaller in the second region A2 than in the first region A1. In this case, by opening the diffuser flow path DC2 from the first region A1, while suppressing separation of the gas G on the inner surface (end wall) of the diffuser flow path DC2 on the downstream side of the first region A1, the gas G can be decelerated without separation even when a large amount of deceleration taken in the first region A1 causes a boundary layer to develop in the second region A2.

Although the embodiments of the present invention have been described in detail above, various modifications can be made in design within the scope without departing from the technical spirit of the present invention. For example, in the diffuser portion 4 (34, 54), the cross-sectional area of the flow path may be expanded so that an inner surface on the radial outer side of the axis O of the diffuser flow path DC (DC1, DC2), that is, an inner surface of the outer shell 4*b*, is inclined toward the radial outer side toward the downstream side. Here, since the gas G is introduced into the diffuser flow path DC in a state in which it has a component in a rotating direction R of the rotating shaft 2, the gas G flows through the inside of the diffuser flow path DC in a state in which the gas G is gathered on the inner surface side on the radial outer side of the diffuser flow path DC.

Therefore, the diffuser flow path DC is formed along such a flow direction of the gas G by expanding the cross-sectional area of the flow path in the diffuser flow path DC to be inclined toward the radial outer side. Accordingly, the gas G can flow more smoothly in the diffuser flow path DC and the effect of pressure recovery can be improved.

Further, in the diffuser portion 4 (34, 54), the cross-sectional area of the flow path may be expanded so that the inner surface on the radial inner side of the axis O of the diffuser flow path DC (DC1, DC2), that is, an inner surface of the combustor basket 4*a*, is inclined toward the radial inner side toward the downstream side. In this manner, in the diffuser flow path DC, in addition to the inner surface on the radial outer side, since the inner surface on the radial inner side is inclined toward the radial inner side toward the downstream side, the diameter of the flow path C expands on both sides in the radial direction and thereby it is possible to perform the pressure recovery with a shorter distance. Thus, a length of the diffuser flow path DC in the direction of the axis O can be decreased, and friction loss of the gas G in the diffuser flow path DC can be reduced.

Also, in the diffuser portion 4 (34, 54), the cross-sectional area of the flow path may be expanded so that the inner surface on the radial inner side of the axis O of the diffuser flow path DC (DC1, DC2), that is, an outer surface of the combustor basket 4*a* is inclined toward the radial outer side toward the downstream side. In this way, in the diffuser flow path DC, in addition to the inner surface on the radial outer side, since the inner surface on the radial inner side is inclined toward the radial outer side toward the downstream side, it is possible to guide the compressed gas G to equipment disposed on the radial outer side.

For example, when the axial flow compressor 1 (31, 51) is applied to a gas turbine, the gas G can be smoothly guided to a combustor disposed on the radial outer side of the diffuser portion 4 (34, 54).

Also, the diffuser flow path DC may be formed to start from a position including the final rotor blade row 20A, that is, an end portion on the upstream side of the final rotor blade row 20A.

In addition, in the embodiments described above, the axial flow compressor 1 (31, 51) has been described as an example of the axial flow rotary machine, but the configurations of the above-described embodiments can be applied to another axial flow rotary machine such as an axial flow pump which pressure-feeds a liquid instead of the gas G Further, instead of the rotor blade 22 having a larger deflection angle on the hub side and the chip side than at the central portion in the blade height direction, that is, in the radial direction of the axis O, the diffuser portion 4, 34, or 54 may be applied to a rotor blade having a uniform deflection angle.

INDUSTRIAL APPLICABILITY

According to the rotor blade and the axial flow rotary machine described above, it is possible to reduce flow loss of a fluid in the diffuser portion and obtain sufficient pressure recovery performance.

REFERENCE SIGNS LIST

1, 31, 51 Axial flow compressor (axial flow rotary machine)
2 Rotating shaft
3 Casing
3*a* Suction port
4, 34, 54 Diffuser portion
4*a* Combustor basket
4*b* Outer shell
10 Stator vane row
10A, 40A First final stator vane row
10B Second final stator vane row
11 Outlet guide vane
12 Stator vane
13 Vane portion
14, 44 Outer shroud
15 Inner shroud
20 Rotor blade row
20A Final rotor blade row
22 Rotor blade
22*a* Suction side
22*b* Pressure side
23 Platform
24 Blade root
25 Blade portion
S Space
G Gas
O Axis
DC, DC1, DC2 Diffuser flow path
C Flow path
A1 First region
A2 Second region
A3 Third region

The invention claimed is:

1. A rotor blade provided in an axial flow rotary machine, wherein the axial flow rotary machine includes:

a rotating shaft which extends in the direction of a longitudinal axis and rotates about the longitudinal axis;

a casing which supports the rotating shaft to be rotatable from an outer circumferential side and defines a flow path of the fluid between the rotating shaft and the casing;

a diffuser portion provided on a downstream side of the casing to communicate with the flow path and form an annular shape about the longitudinal axis and configured to define a diffuser flow path in which a cross-sectional area of the flow path expands toward the downstream side;

a plurality of stator vane rows provided in a direction of the longitudinal axis and protruding from the casing toward a radial inner side of the longitudinal axis; and a plurality of rotor blade rows provided adjacent to the stator vane rows in the direction of the longitudinal axis and configured to perform compressing or pressure-feeding of the fluid, the plurality of rotor blades are provided to be spaced apart from each other in a circumferential direction of the longitudinal axis and configured to constitute a final rotor blade row positioned on a most downstream side of a flow of a fluid among rotor blade rows, and comprises a blade portion having a larger deflection angle on a hub side and a chip side than at a central portion in a blade height direction, in the blade portion, the deflection angle is larger on the hub side and the chip side than at the central portion in the blade height direction in each rotor blade, on an outlet of the blade portion in each rotor blade, a flow direction of the fluid on the hub side and a flow direction of the fluid on the chip side are different from a flow direction of the fluid at the central portion, and a compression amount of the fluid on the hub side and a compression amount of the fluid on the chip side are larger than a compression amount of the fluid at the central portion.

2. The axial flow rotary machine according to claim 1, further comprising stator vanes provided to be spaced apart from each other in a circumferential direction of the axis in each of the rows.

3. The axial flow rotary machine according to claim 2, wherein the diffuser portion is provided in the casing so that the diffuser flow path extends on the downstream side of an end portion on an upstream side of a final rotor blade row and from an upstream side of an end portion on the downstream side of a final stator vane row provided further downstream from the final rotor blade row.

4. The axial flow rotary machine according to claim 3, wherein, in the diffuser portion, a portion of an inner surface of the diffuser flow path is formed with a portion of the stator vane of the final stator vane row.

5. The axial flow rotary machine according to claim 3, wherein, in the diffuser portion:

the diffuser flow path is divided into a first region corresponding to a region in the direction of the longitudinal axis in which the final stator vane row is provided, a second region on the downstream side of the first region, and a third region further downstream from the second region; and an amount of expansion in a cross-sectional area of the flow path in the second region is larger than that in the first region and an amount of expansion in a cross-sectional area of the flow path in the third region is smaller than that in the second region.

6. The axial flow rotary machine according to claim 3, wherein, in the diffuser portion:

the diffuser flow path is divided into a first region corresponding to a region in the direction of the longitudinal axis in which the final stator vane row is provided, and a second region on the downstream side of the first region; and an amount of expansion in a cross-sectional area of the flow path in the second region is smaller than that in the first region.

7. The axial flow rotary machine according to claim 3, wherein, in the diffuser portion, the cross-sectional area of the flow path expands so that an inner surface on a radial outer side of the longitudinal axis in the diffuser flow path is inclined toward the radial outer side toward the downstream side.

8. The axial flow rotary machine according to claim 7, wherein, in the diffuser portion, the cross-sectional area of the flow path expands so that the inner surface on the radial inner side of the longitudinal axis in the diffuser flow path is inclined toward the radial inner side toward the downstream side.

9. The axial flow rotary machine according to claim 7, wherein, in the diffuser portion, the cross-sectional area of the flow path expands so that the inner surface on the radial inner side of the longitudinal axis in the diffuser flow path is inclined toward the radial outer side toward the downstream side.

* * * * *